US009078061B2

(12) United States Patent
Shimura et al.

(10) Patent No.: US 9,078,061 B2
(45) Date of Patent: Jul. 7, 2015

(54) STEREO RIBBON MICROPHONE

(75) Inventors: Haruhito Shimura, Tokyo (JP); Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 598 days.

(21) Appl. No.: 13/415,199

(22) Filed: Mar. 8, 2012

(65) Prior Publication Data

US 2012/0230498 A1 Sep. 13, 2012

(30) Foreign Application Priority Data

Mar. 9, 2011 (JP) ..... 2011-051800

(51) Int. Cl.
*H04R 25/00* (2006.01)
*H04R 5/027* (2006.01)
*H04R 9/04* (2006.01)

(52) U.S. Cl.
CPC ..... *H04R 5/027* (2013.01); *H04R 9/048* (2013.01)

(58) Field of Classification Search
USPC ..... 381/1, 17, 18, 19, 26, 91, 92, 111, 122, 381/150, 176, 355, 375, 399, 113, 115
See application file for complete search history.

(56) References Cited

U.S. PATENT DOCUMENTS

| | | | | |
|---|---|---|---|---|
| 4,262,170 | A | 4/1981 | Bauer | |
| 8,009,843 | B2 * | 8/2011 | Akino | 381/113 |
| 2006/0222187 | A1 * | 10/2006 | Jarrett et al. | 381/92 |
| 2008/0285770 | A1 * | 11/2008 | Wu et al. | 381/92 |
| 2011/0188680 | A1 * | 8/2011 | Akino | 381/176 |
| 2012/0300959 | A1 * | 11/2012 | Marshall et al. | 381/111 |

FOREIGN PATENT DOCUMENTS

| | | |
|---|---|---|
| JP | 55-143089 A | 11/1980 |
| JP | 6-303691 | 10/1994 |

OTHER PUBLICATIONS

Ron Streicher and Wes Booley, The Bidirectional Microphone: A Forgotten Patriarch, Audio Eng. Soc., vol. 51, No. 3, Mar. 2003, pp. 211-225.*

Takeo Yamanoto, Quadraphonic One Point Pickup Microphone, Audio Eng. Soc., 43rd Convention of the Audio Engineering Society, New York, Sep. 12, 1972, pp. 256-261.*

* cited by examiner

*Primary Examiner* — Vivian Chin
*Assistant Examiner* — Friedrich W Fahnert
(74) *Attorney, Agent, or Firm* — Whitham Curtis Christofferson & Cook, PC

(57) ABSTRACT

A stereo ribbon microphone includes four ribbon microphone units disposed in a circle on a single horizontal plane. The ribbon microphone units are alternately assigned to a right channel and a left channel along the circumferential of the circle.

6 Claims, 9 Drawing Sheets

STEREO RIBBON MICROPHONE

BACKGROUND OF THE INVENTION

1. Technical Field

The present invention relates to a stereo ribbon microphone that has excellent stereo sound-collecting ability even with a plurality of microphone units disposed on the same plane, without the effect of structures positioned near the microphone units on acoustic characteristics.

2. Background Art

A stereo microphone includes two microphone units which output signals of two channels, i.e., left and right channels, respectively, as is described in Japanese Unexamined Patent Application Publication No. 06-303691.

A typical stereo microphone includes two bidirectional microphone units, one having a directional axis tilted 45° to the left and the other having a directional axis of tilted 45° to the right, from the front of the microphone. The sound-collecting system employed for the stereo microphone is referred to as a Blumlein array. There are two types of bidirectional microphone units included in the Blumlein array: electrostatic condenser microphone unit and conductive ribbon microphone unit.

Typically, the directional axes of the two microphone units of a stereo microphone are disposed on a single horizontal plane. However, for bidirectional microphone units in a Blumlein array, microphone units assigned to the left and right channels should rather not be disposed alongside each other because the microphone may be short of performance unless structures near the microphone units are positioned symmetrically in the anterior-posterior direction with respect to the acoustic center.

SUMMARY OF THE INVENTION

In a typical stereo ribbon microphone, two bidirectional units are vertically stacked, as illustrated in FIG. 9. In the stereo ribbon microphone 1 illustrated in FIG. 9, two ribbon microphones 2*a* and 2*b* are vertically stacked inside a microphone case 3, and external audio signals reach the ribbon microphone units 2*a* and 2*b* through a shield mesh 4 attached to a microphone case 3.

The microphone case 3 accommodates step-up transformers 5*a* and 5*b*. The outputs from the ribbon microphone units 2*a* and 2*b* are sent to a 5-pin connector 7 via the step-up transformers 5*a* and 5*b*, respectively, and finally to an external device. The 5-pin connector 7 includes hot and cold terminals corresponding to the step-up transformer 5*a* and 5*b* and a ground terminal. The microphone case 3 also accommodates a circuit board 6 that functions as a buffer amplifier.

In such a known stereo ribbon microphone, the directional axes of the two microphone units reside on different horizontal planes, which configuration is not preferable for stereo sound collection. Since the directional axes of the two ribbon microphone units, which are vertically stacked, do not reside on the same horizontal plane, the bias in the vertical (longitudinal) direction of the sound source is collected separately by the two microphone units and is output as a bias in the horizontal (transverse) direction.

Additionally, the vertical length (length in the longitudinal direction of the ribbon) of the ribbon microphone unit is large because the length of the ribbon functioning as a diaphragm is maximized to achieve high sensitivity. A known stereo ribbon microphone having two ribbon microphone units vertically stacked thus has a large bias in the vertical direction of the ribbon microphone units. This causes a decrease in the ability of the stereo microphone to separately collect sounds from the left and right.

Hence, there is a need for a stereo ribbon microphone that can achieve compatibility between excellent stereo sound-collecting ability even with a plurality of microphone units disposed on a single plane and the suppressed effect of structures near the microphone units on acoustic characteristics.

An object of the present invention, which has been conceived in light of the problems described above, is to provide a stereo ribbon microphone that has excellent stereo sound-collecting ability even with a plurality of microphone units disposed on a single plane, without the effect of structures near the microphone units on acoustic characteristics.

The stereo ribbon microphone according to the present invention includes four ribbon microphone units disposed in a circle on a single horizontal plane, wherein the four ribbon microphone units are alternately assigned to a right channel and a left channel along the circumference of the circle.

The present invention provides a stereo ribbon microphone that has excellent stereo sound-collecting ability even with a plurality of microphone units disposed on a single plane, without the effect of structures near the microphone units on acoustic characteristics.

DESCRIPTION OF THE PREFERRED EMBODIMENTS

Figure 9:
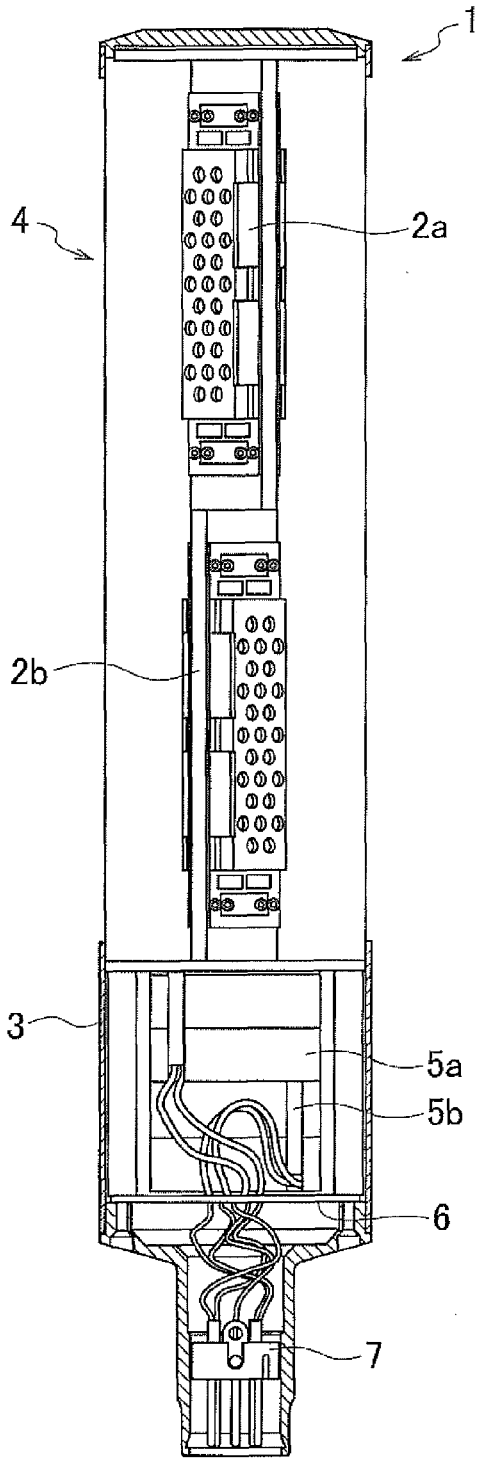
FIG. 9 is a sectional view of a known stereo ribbon microphone.

A stereo ribbon microphone according to an embodiment of the present invention will be described below with reference to the accompanying drawings. Components that are the same as those illustrated in FIG. 9, which illustrates an example of the conventional art, will be represented by the same reference numerals.

Figure 1:
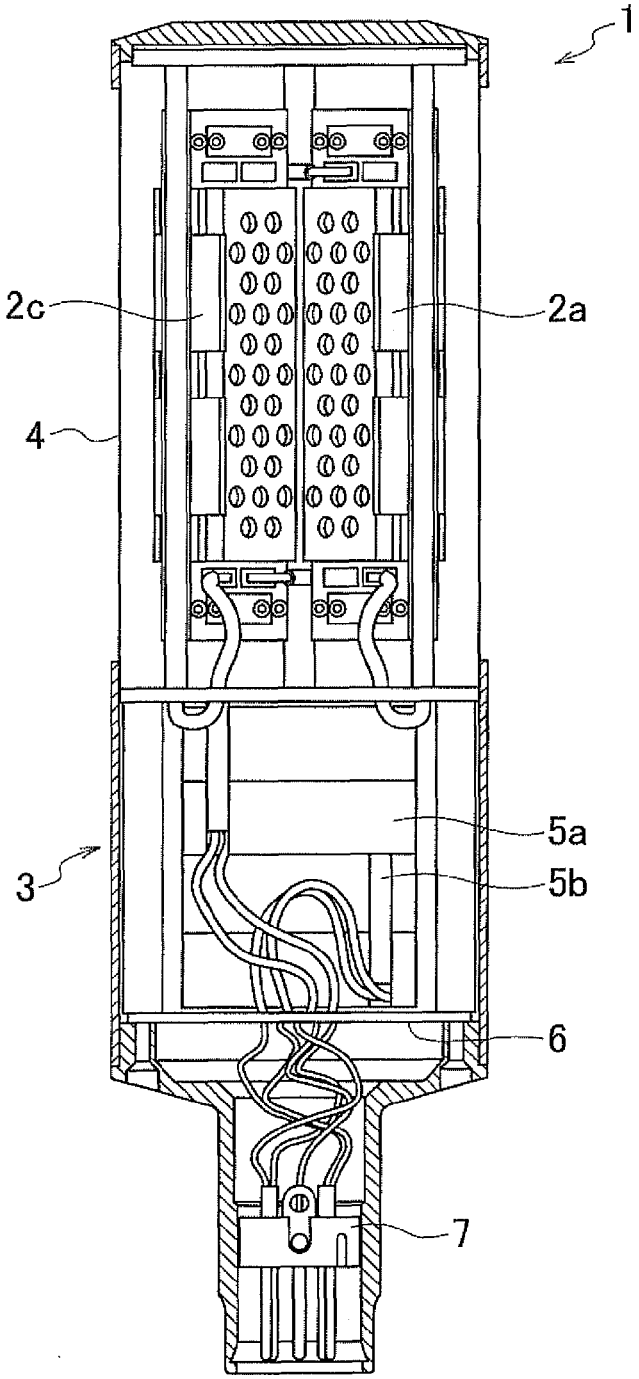
FIG. 1 is a longitudinal sectional view of a stereo ribbon microphone according to an embodiment of the present invention.
Figure 2:
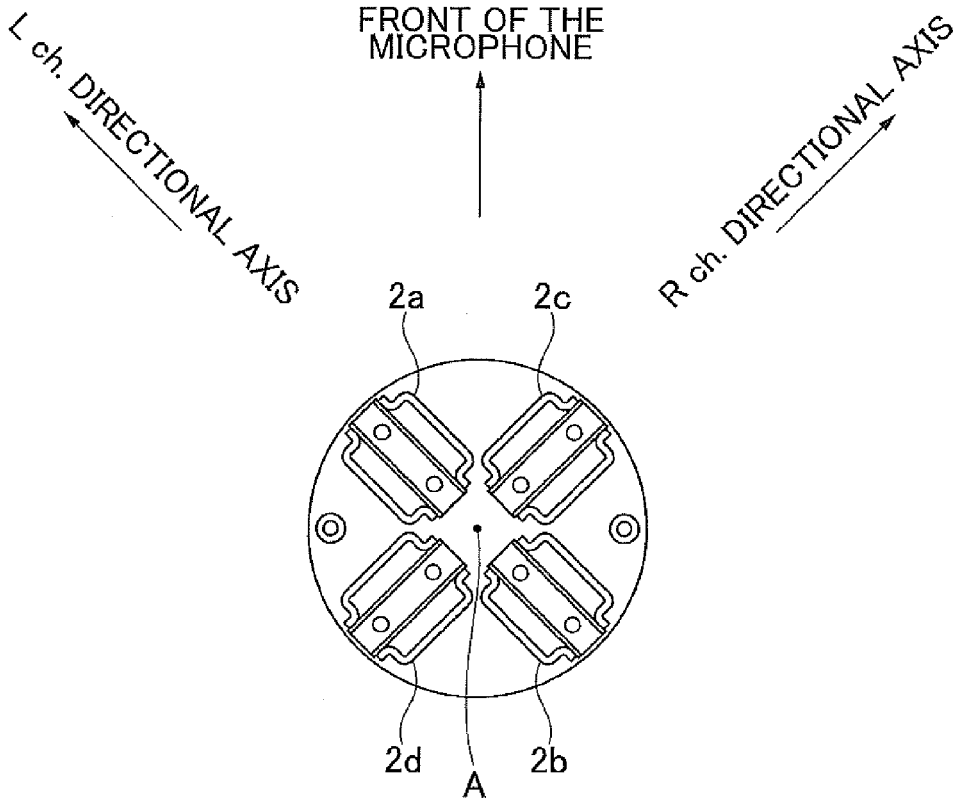
FIG. 2 is a transverse sectional view of microphone units of the stereo ribbon microphone illustrated in FIG. 1.

As illustrated in FIGS. 1 and 2, a stereo ribbon microphone 1 according an embodiment of the present invention includes four ribbon microphone units 2*a*, 2*b*, 2*c*, and 2*d*, which are accommodated inside a microphone case 3 with their directional axes disposed on a single horizontal plane. External audio signals reach the ribbon microphone units 2*a*, 2*b*, 2*c*, and 2*d* through a shield mesh 4 attached to the microphone case 3.

The microphone case 3 also accommodates step-up transformers 5*a* and 5*b*. The outputs from the ribbon microphone units 2*a* and 2*b* are sent to the step-up transformer 5*a*, and the outputs from the ribbon microphone units 2*c* and 2*d* are sent to the step-up transformer 5*b*. The outputs from the step-up transformer 5*a* and 5*b* are sent to a 5-pin connector 7 and then to an external device. The 5-pin connector 7 includes hot and cold terminals corresponding to the step-up transformer 5*a* and 5*b* and a ground terminal. The microphone case 3 also accommodates a circuit board 6 that functions as a buffer amplifier.

The ribbon microphone units 2*a*, 2*b*, 2*c*, and 2*d* are disposed in the microphone case 3 such that their directional axes are positioned on a single horizontal plane, as illustrated in FIG. 2. As already known, the ribbon microphone units 2*a*, 2*b*, 2*c*, and 2*d* each have a pair of long, prismatic permanent magnets across which a magnetic field is generated and a conductive ribbon disposed in the magnetic field to function as a diaphragm. The ribbon of which both ends in the longitudinal direction are fixed vibrates upon receiving sonic waves and intersects the magnetic fluxes of the magnetic field, causing electric signals corresponding to the sonic waves to be outputted from both ends of the ribbon.

The ribbon microphone units 2*a* and 2*b* are assigned to the right channel, while the ribbon microphone units 2*c* and 2*d* are assigned to the left channel. The right-channel microphone units 2*a* and 2*b* are disposed inside the microphone case 3 such that their sound-collecting axes, i.e., the directions orthogonal to the surface of the ribbon, are tilted by 45° to the left from the front of the microphone and such that the sound-collecting axes are parallel to each other. The left-channel microphone units 2*c* and 2*d* are disposed inside the microphone case 3 such that their sound-collecting axes, i.e., the directions orthogonal to the surface of the ribbon, are tilted by 45° to the right from the front of the microphone and such that the sound-collecting axes are parallel to each other. The ribbon microphone units 2*a*, 2*b*, 2*c*, and 2*d* are disposed such that the directional axes of adjacent ribbon microphone units define a 90-degree angle. The acoustic center of the ribbon microphone units is positioned at the center of the space surrounded by the ribbon microphone units, as indicated by point A in FIG. 2. The ribbon microphone units are positioned symmetrically to each other with respect to the acoustic center A. The directional characteristics of the four ribbon microphone units are illustrated in FIG. 3.

Figure 3:
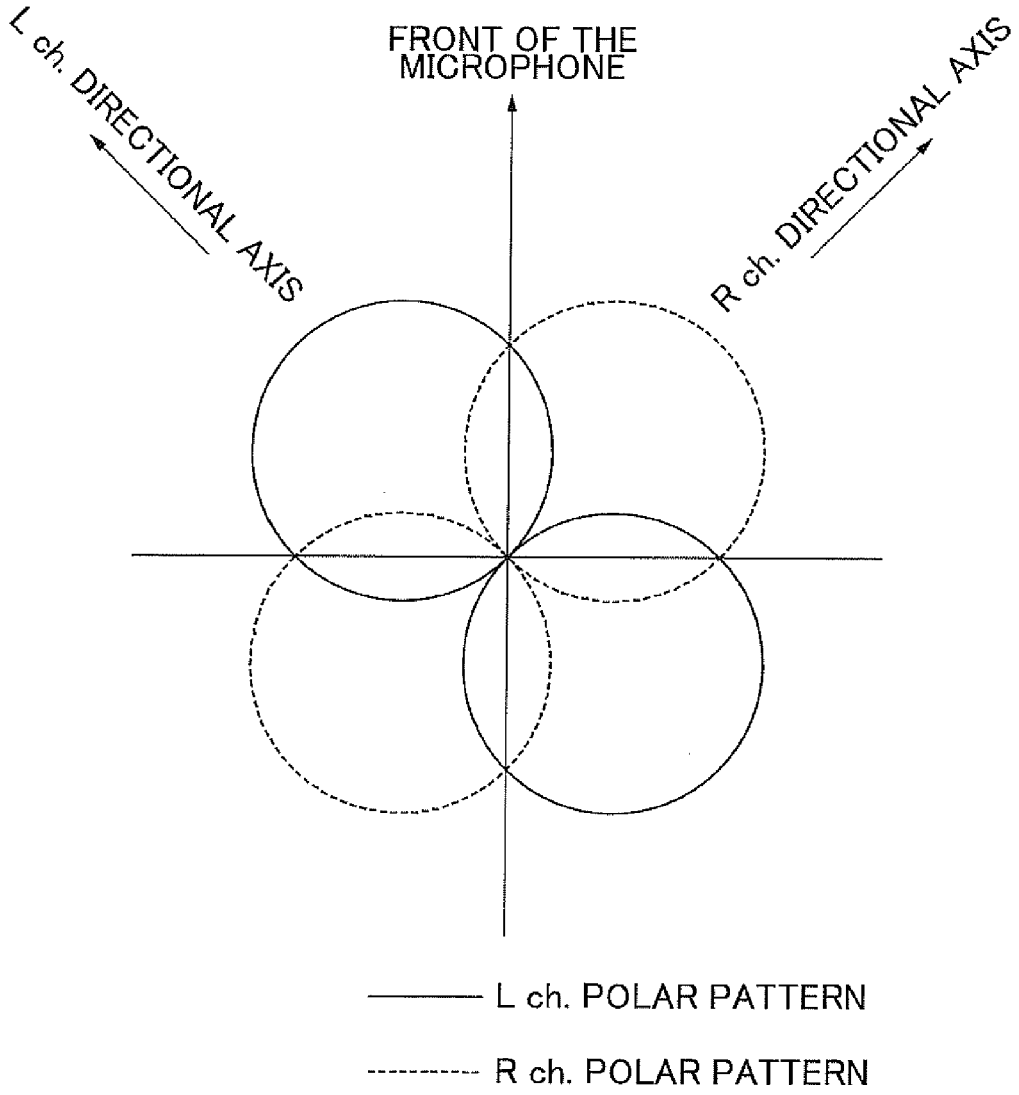
FIG. 3 is a graph illustrating the directional characteristics of stereo ribbon microphone units according to the embodiment.

In FIG. 3, the solid lines represent a polar pattern of the left-channel ribbon microphone units, and the dotted lines represent a polar pattern of the right-channel ribbon microphone units. The directional axes of the right-channel ribbon microphone units are tilted by 45° to the right from the front of the microphone, and the directional axes of the left-channel ribbon microphone units are tilted by 45° to the left from the front of the microphone.

Figure 4:
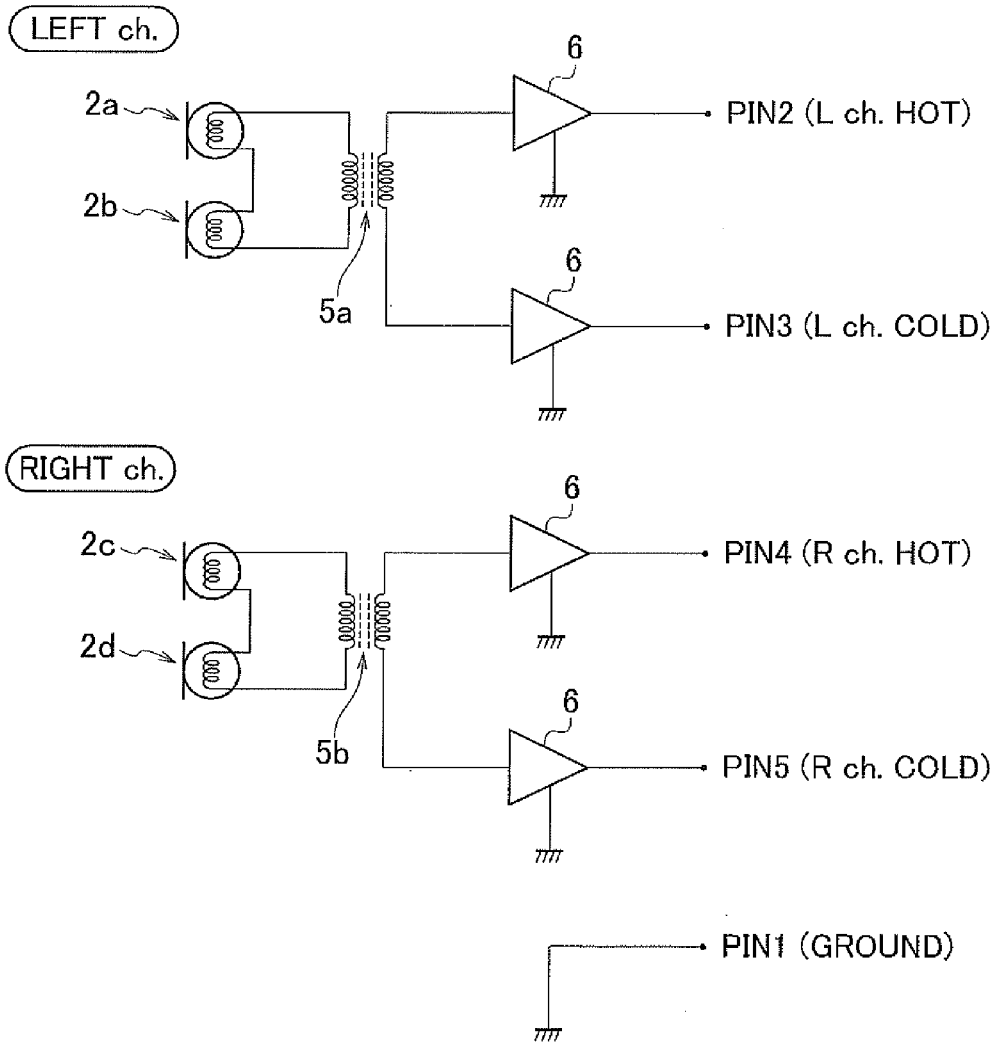
FIG. 4 is a circuit diagram of the stereo ribbon microphone units according to the embodiment.

The circuit configuration of the stereo ribbon microphone 1 is illustrated in FIG. 4. The right-channel ribbon microphone units 2*a* and 2*b* are connected in series, while the left-channel ribbon microphone units 2*c* and 2*d* are connected in series.

The ribbon microphone units 2*a* and 2*b* are connected to a primary winding of the step-up transformer 5*a* so that the serial output of the ribbon microphone units 2*a* and 2*b* is input to the primary winding. The ends of a second winding of the step-up transformer 5*a* are connected to the hot and cold balance outputs via corresponding buffer amplifiers 6.

The ribbon microphone units 2*c* and 2*d* are connected to a primary winding of the step-up transformer 5*b* so that the serial output of the ribbon microphone units 2*c* and 2*d* is input to the primary winding. The ends of a second winding of the step-up transformer 5*b* are connected to the hot and cold balance outputs via corresponding buffer amplifiers 6.

Audio signals are output from the 5-pin connector 7 having the hot and cold terminals of the step-up transformers 5*a* and 5*b* and a ground terminal to an external device (not shown).

Figure 5:
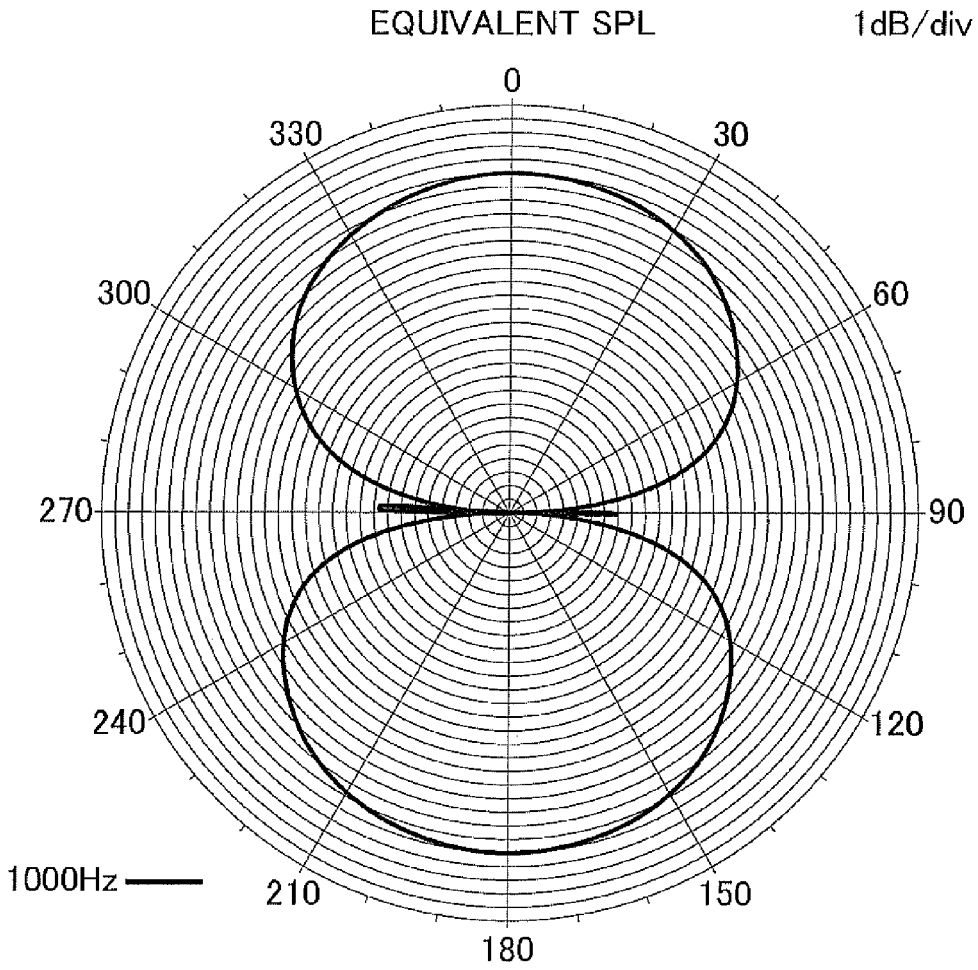
FIG. 5 is a graph illustrating the results of the observed acoustic characteristics of left-channel ribbon microphone units of the stereo ribbon microphone according to the embodiment.
Figure 6:
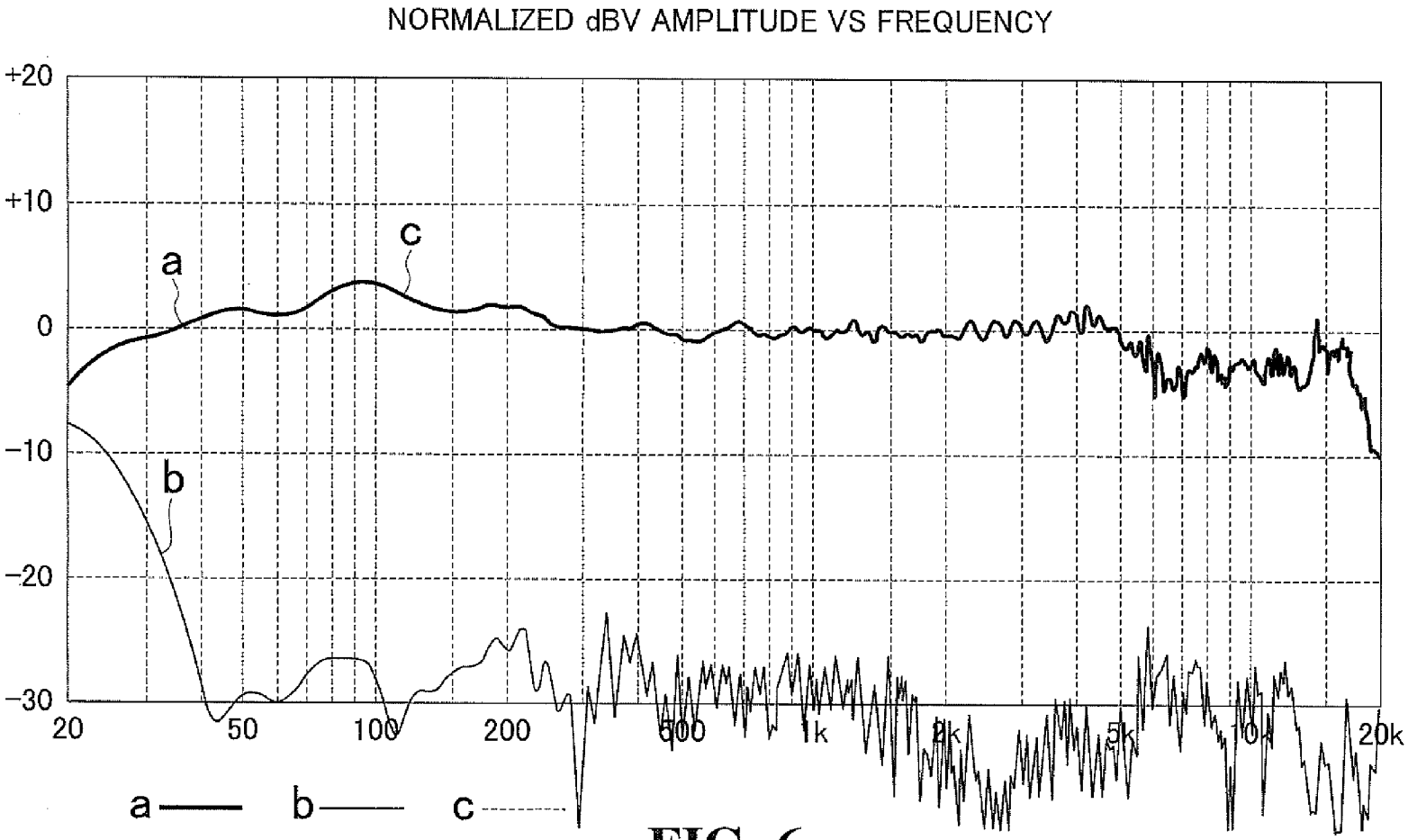
FIG. 6 is another graph illustrating the results of observed acoustic characteristics of left-channel ribbon microphone units according to the embodiment.
Figure 7:
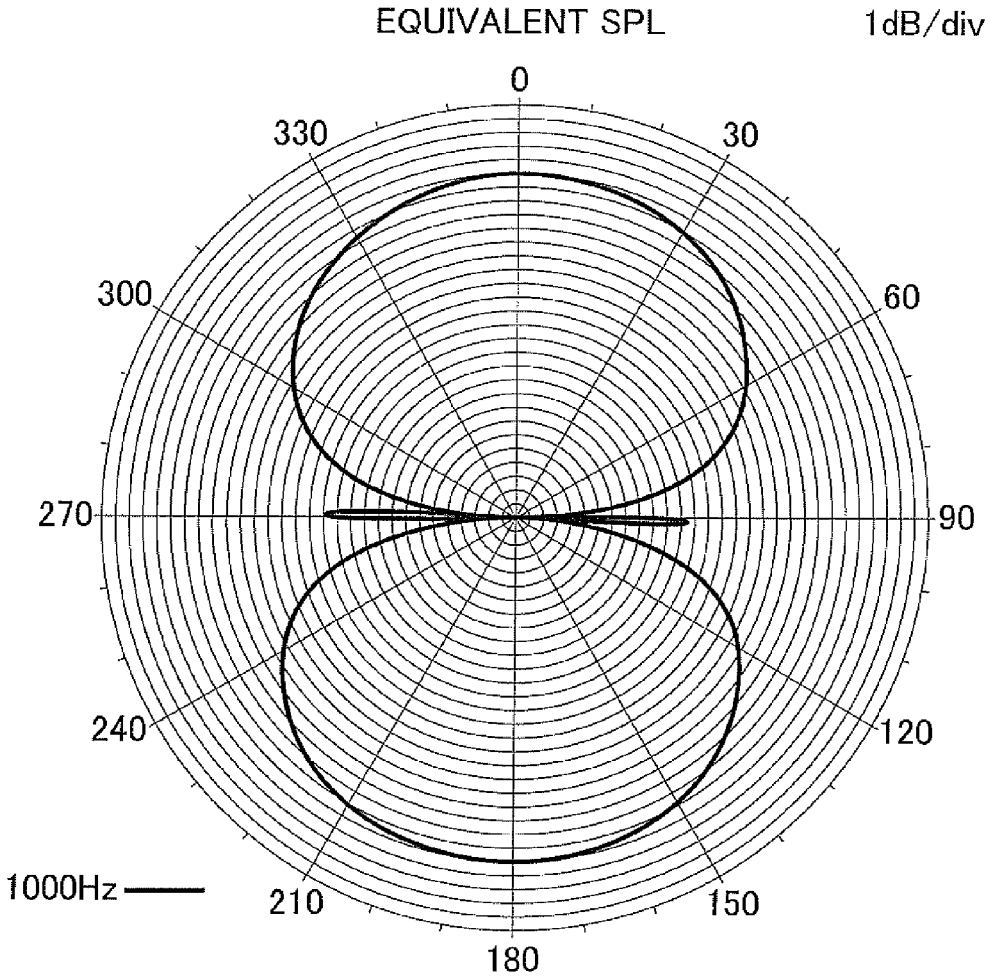
FIG. 7 is a graph illustrating the results of the observed acoustic characteristics of right-channel ribbon microphone units of the stereo ribbon microphone according to the embodiment.
Figure 8:
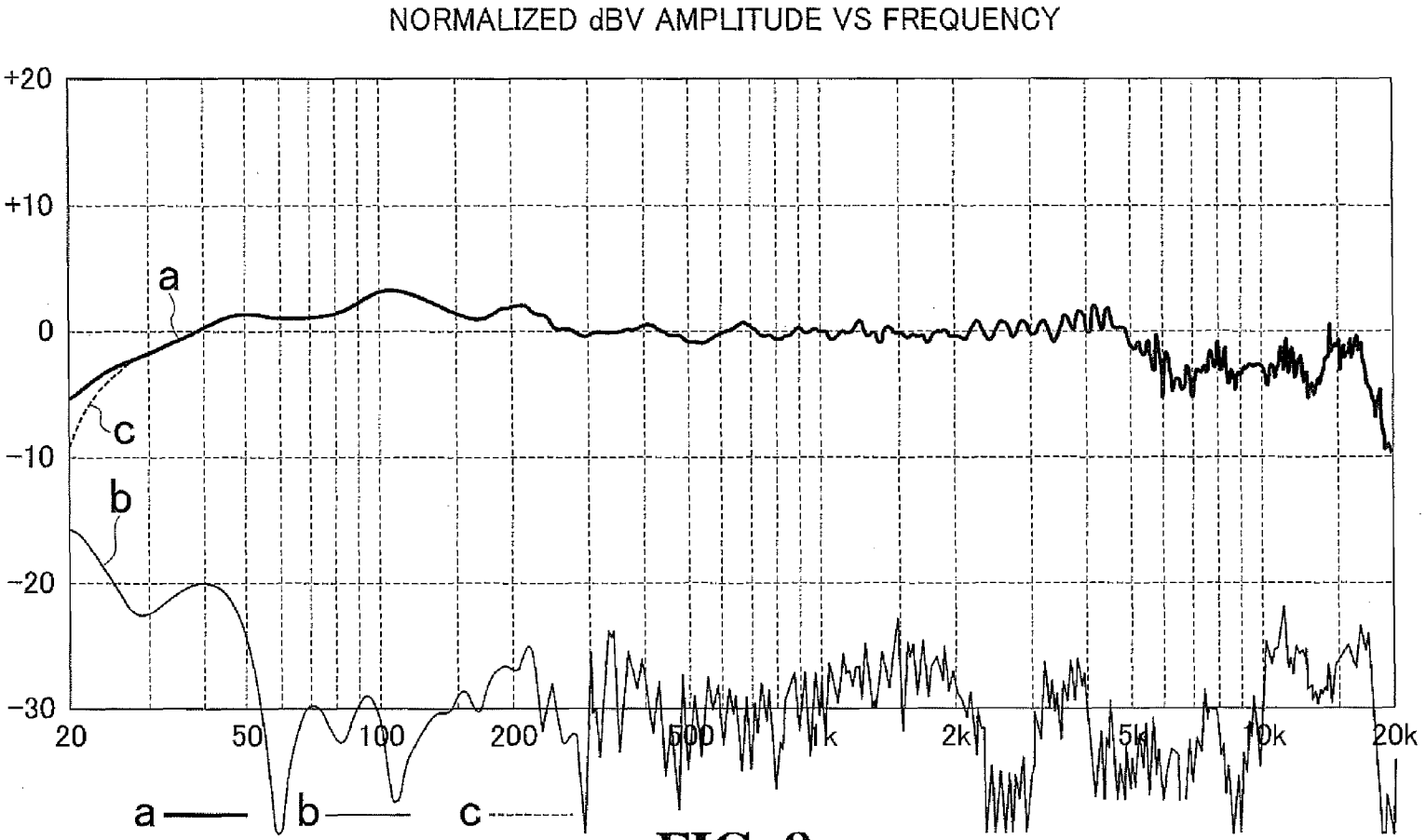
FIG. 8 is another graph illustrating the results of the observed acoustic characteristic of right-channel ribbon microphone units according to the embodiment.

The results of the observed acoustic characteristics of the stereo ribbon microphone according to the embodiment are illustrated in FIGS. 5 to 8. FIGS. 5 and 6 illustrate the acoustic characteristics of the left-channel ribbon microphone units, while FIGS. 7 and 8 illustrate the acoustic characteristics of the right-channel ribbon microphone units. FIGS. 6 and 8 illustrate the sound collecting characteristics in directions A, B, and C, where A represents 0° (front side), B represents 90° (lateral side), and C represents 180° (back side). As illustrated in the drawings, the left and right-channel ribbon microphone units are bidirectional.

The stereo ribbon microphone according to the present invention includes four microphone units positioned symmetrically with respect to the acoustic center. Thus, the stereo ribbon microphone according to the present invention can effectively suppress the influence of the structures inside the microphone near the microphone units on the acoustic characteristics, which is inherent in conventional stereo ribbon microphones. In the stereo ribbon microphone according to the present invention, the four microphone units are disposed such that the directional axes are positioned on a single plane. Thus, the stereo ribbon microphone according to the present invention exhibits excellent stereo sound-collecting ability because the bias of a sound source in the vertical (longitudinal) direction is not output as a bias in the horizontal (transverse) direction.

What is claimed is:

1. A stereo ribbon microphone comprising:

four ribbon microphone units disposed in a circle on a single horizontal plane inside a single microphone case, wherein the four ribbon microphone units are alternately assigned to a right channel and a left channel along the circumference of the circle, wherein the ribbon microphone units are positioned symmetrically to each other with respect to an acoustic center and within said single microphone case, the two ribbon microphone units assigned to the right channel are connected in series, and the two ribbon microphone units assigned to the left channel are connected in series.

2. The stereo ribbon microphone according to claim 1, wherein the four ribbon microphone units are arranged such that directional axes of two adjacent ribbon microphone units intersect at a 90-degree angle.

3. The stereo ribbon microphone according to claim 1, wherein the two ribbon microphone units connected in series are connected to a primary winding of a step-up transformer, and both ends of a secondary winding of the step-up transformer are connected to hot and cold balance outputs, respectively.

4. The stereo ribbon microphone according to claim 1, wherein the two ribbon microphone units connected in series are connected to a primary winding of a step-up transformer, and both ends of a secondary winding of the step-up transformer are connected to hot and cold balance outputs, respectively.

5. The stereo ribbon microphone according to claim 3, further comprising hot and cold terminals of the two ribbon microphone units assigned to the right channel, hot and cold terminals of the two ribbon microphone units assigned to the left channel, and a ground terminal.

6. The stereo ribbon microphone according to claim 4, further comprising hot and cold terminals of the two ribbon microphone units assigned to the right channel, hot and cold terminals of the two ribbon microphone units assigned to the left channel, and a ground terminal.

* * * * *